United States Patent [19]

Tanabe

[11] Patent Number: 4,636,601

[45] Date of Patent: Jan. 13, 1987

[54] PUSH-PUSH SWITCH

[75] Inventor: Osamu Tanabe, Miyagi, Japan

[73] Assignee: Alps Electric Co., Ltd., Japan

[21] Appl. No.: 724,185

[22] Filed: Apr. 17, 1985

[30] Foreign Application Priority Data

Apr. 20, 1984 [JP] Japan ..... 59-58308[U]

[51] Int. Cl.[4] ..... H01H 3/00

[52] U.S. Cl. ..... 200/153 J; 200/328

[58] Field of Search ..... 200/153 J, 153 JH, 16 C, 200/328

[56] References Cited

U.S. PATENT DOCUMENTS

| | | | |
|---|---|---|---|
| 2,956,446 | 10/1960 | Ensign, Jr. et al. | 200/153 J |
| 4,382,167 | 5/1983 | Maruyama et al. | 200/153 J |
| 4,383,153 | 5/1983 | Kondo et al. | 200/153 J |
| 4,404,436 | 9/1983 | Ohba | 200/153 J |

FOREIGN PATENT DOCUMENTS

| | | | |
|---|---|---|---|
| 1164260 | 9/1969 | United Kingdom | 200/153 J |

*Primary Examiner*—Stephen Marcus
*Assistant Examiner*—Linda J. Sholl
*Attorney, Agent, or Firm*—Guy W. Shoup

[57] ABSTRACT

A push-push switch comprises a reciprocatable operation shaft assembled in a housing, a movable contact responsive to operation of the operation shaft, and a heart-shaped cam for locking selectively the operation shaft at a certain position when the operation shaft is pushed in opposition to a recovery spring. An operation spring attached to the heart-shaped cam for pushing the heart-shaped cam toward the operation shaft is made of a plate spring which has two bent hook pieces and a band-like pushing spring portion.

1 Claim, 9 Drawing Figures

PUSH-PUSH SWITCH

FIELD OF THE INVENTION

The present invention relates to a push-push switch and, particularly, to the push-push switch equipped with a heart-shaped cam for locking an operation shaft in response to a pushing action.

BACKGROUND OF THE INVENTION

A push-push switch is generally known which comprises an operation shaft movable inwardly of a housing and actuating a movable contact. A heart-shaped cam is provided within the housing for locking selectively the operation shaft at a certain position, and is designed so that in response to initial movement of the operation shaft within the housing, this shaft is locked by the heart-shaped cam in a position where the movable contact engages a first fixed contact. In response to further inward movement of the operation shaft, it is released from the locked state and the movable contact engages another fixed contact. In the foregoing structure, the heart-shaped cam pivots reciprocatingly in response to the bias of a recovery spring and the movement of the operation shaft, whereby the foregoing locking function is attained.

In the foregoing example of a conventional structure, because the heart-shaped cam is designed so that it is biased constantly by a coil spring and pivotable, the lock mechanism portion of the switch needs a large space. Further, because the coil spring must be positioned within the housing under a compressed state when assembling the switch, the assembling process is troublesome and the productivity is poor.

SUMMARY OF THE INVENTION

It is an object of the present invention to improve such inconveniences as above, and thus provide a push-push switch which allows miniaturization and is excellent in productivity.

The present invention resides in a push-push switch which comprises an operation shaft assembled in a housing, a movable contact responsive to operation of the operation shaft, and a heart-shaped cam for locking selectively the operation shaft at certain positions as it is moved inwardly of the housing against the bias of a return spring. An operation spring in the form of a plate spring is attached to the heart-shaped cam, and this plate spring has two integral hook pieces spaced a certain distance, one of these hook pieces being engaged with the housing and the other being engaged with the heart-shaped cam. By these structures the heart-shaped cam can very easily be assembled in the housing and a space for accommodating the operation spring can be made small owing to the property of the plate spring.

DETAILED DESCRIPTION OF THE INVENTION

The present invention will be described with reference to FIGS. 1 through 9 showing an embodiment thereof.

Figure 1:
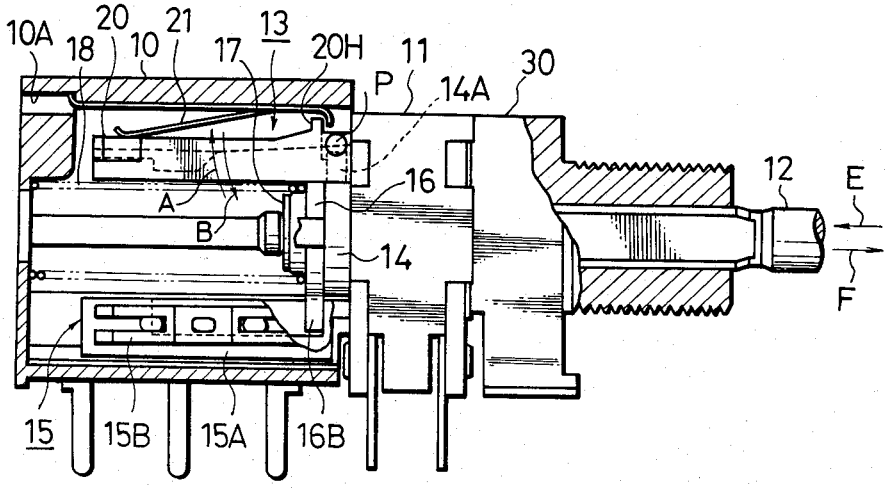
FIG. 1 is a sectional view of an embodiment of the present invention with a portion omitted.
Figure 2:
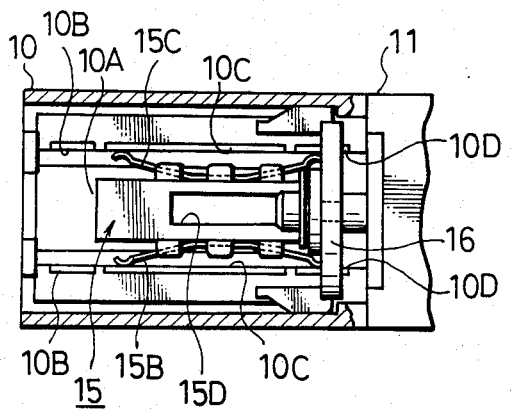
FIG. 2 is an explanatory sectional view of a movable contact portion as viewed from above FIG. 1.

As illustrated in FIGS. 1 and 2, a housing 10 for the heart-shaped cam is connected to a variable resistor 11 and a fixing portion 30. An operation shaft 12 is arranged in the central portion of the housing 10 and passes through the variable resistor portion 11 and the fixture portion 30. A first drive member 14 and a second drive member 16 are attached to the operation shaft 12, and are held in position by E-ring 17. A return spring 18 is provided around the left-end portion of the operation shaft 12 to urge it towards its initial, rightward position.

Figure 3:
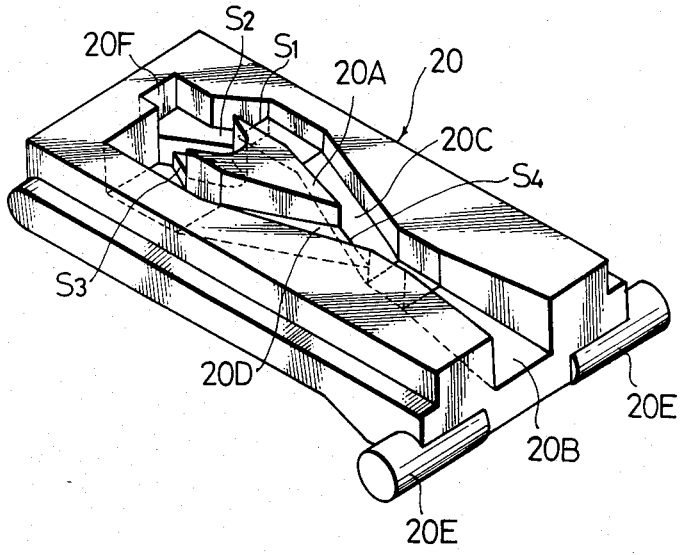
FIG. 3 is a perspective view of an example of the heart-shaped cam.

The lock mechanism 13 comprises, in the embodiment, a heart-shaped cam 20 pivotable in the directions of the arrows A and B with a point P serving as its pivoting fulcrum, and a plate spring 21 for constantly urging the pivoting end portion of the heart-shaped cam 20 towards the operation shaft 12. The structure of the heart-shaped cam 20 is as follows. As shown in FIG. 3, at the center portion of the cam a heart-shaped guide/-hook projection 20A is provided, on either side of which are provided an outward guide groove 20C and a return guide groove 20D branching from a main guide groove 20B. At junction portions between the respective guide grooves 20B, 20C and 20D are formed stepped portions $S_1$, $S_2$, $S_3$ and $S_4$ for preventing backward movement of the operation shaft 12, as will be described more fully below. A pivot supporting shaft 20E provides the point P, and a groove 20F is provided at one end as shown. A driving projection 14A extending outwards from one end of the first drive member 14 is engageable with the grooves 20B and 20F of the heart-shaped cam groove.

Figure 5:
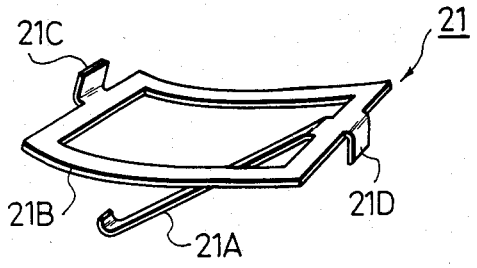
FIG. 5 is a perspective view of a plate spring means.

As shown in FIG. 5, the plate spring 21 comprises a frame portion 21B with a band-like spring portion 21A extending downwards from a midpoint of one end of the frame portion. Hook pieces 21C and 21D are formed at respective ends of the frame portion 21B, and are bent in opposite directions as shown. One hook piece 21C is engaged in an anchor groove 10A of the housing 10 and the other hook piece 21D is suspended from a projection 20H of the heart-shaped cam 20. Accordingly, by these elements the plate spring 21 and the heart-shaped cam 20 can be assembled in the frame body 10 very easily, quickly and surely.

The movable contact 15 comprises a movable member 15A positioned under the operation shaft 12 as viewed in FIG. 1, and spring contacts 15B, 15C extending laterally from respective sides of the movable member 15A as shown in FIG. 2. At the upper portion of the movable member 15A as viewed in FIG. 1 is formed a recessed groove 15D, and a hook projection 16B of the second drive member 16 described hereinafter is adapted to couple with the groove 15D to move the movable member 15A. In correspondence to the spring contacts 15B, 15C, fixed contacts 10B, 10C, 10D are mounted separately on the housing 10 so that in response to movement of the spring contacts 15B, 15C the predetermined circuit contacts can be selected.

Figure 4:
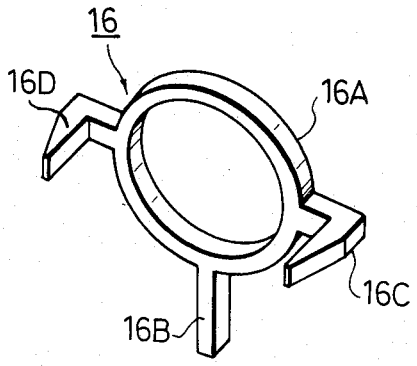
FIG. 4 is a perspective view of a second drive member.

The second drive member 16 for the movable contact means 15 comprises, as shown in FIG. 4, a ring body 16A, and the hook projection 16B extends downward from the lower portion of the ring body 16A. Guide arm portions 16C, 16D are formed at respective side portions of the ring body 16A. These guide arm portions 16C, 16D engage slidably with guide grooves formed in the side walls of the housing 10, so that reciprocating movement of the operation shaft 12 in the directions of the arrows E and F is allowed smoothly. The movable contact 15 is also reciprocatable smoothly, and thus its switching action of the circuit contacts is achieved smoothly.

Now, the overall operation of the foregoing embodiment will be described.

Figure 6:
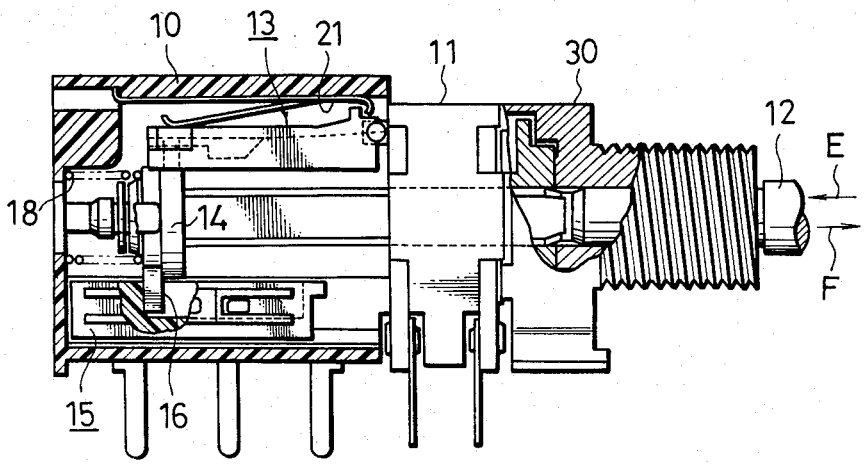
FIGS. 6 through 9 are explanatory views showing respective operation stages of the switch.
Figure 7:
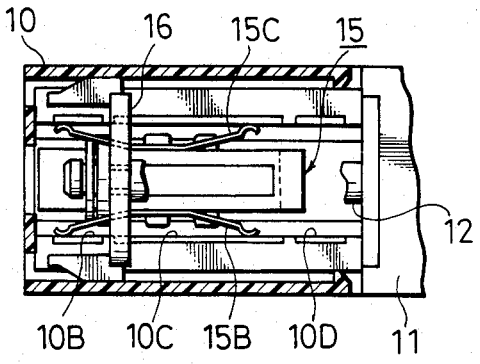
Figure 8:
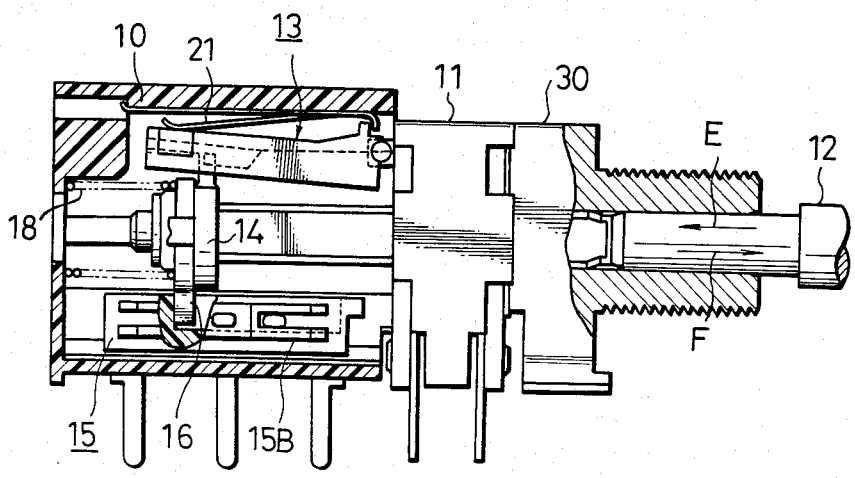
Figure 9:
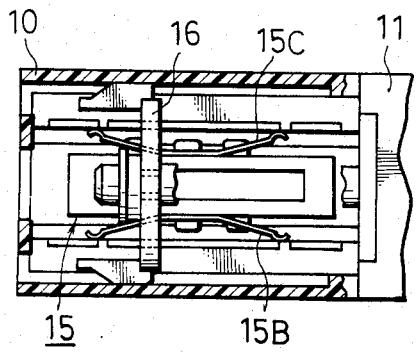

As the operation shaft 12 is pushed inwardly in opposition to the recovery spring 18 from the state shown in FIG. 1, the operation shaft 12 moves leftwardly together with the first and second drive members 14, 16 to the position shown in FIGS. 6 and 7. During this operation, the driving projection 14A of the first drive member 14 slides through the outward guide groove 20C of the heart-shaped cam 20 and is guided to preventing groove 20F, and, on the other hand, the hook projection 16B of the second drive member 16 comes into engagement with the movable contact means 15 and moves the same, so that the circuit contacts are switched from "10C–10D" to "10B–10C". Then, if the external force is removed gradually from the operation shaft 12, this shaft 12 moves in the direction of the arrow F together with the first and second drive members 14, 16. At this moment, the driving projection 14A of the first drive member 14 is engaged with the guide/-hook projection 20A of the heart-shaped cam 20 and restrained at the position shown in FIGS. 8 and 9 thereby resulting in the locked state of the present push-push switch. Then, as the operation shaft 12 is pushed again in the direction of the arrow E, the driving projection 14A of the first drive member 14 is released from the locked state under the guide/hook projection 20A. Succeedingly, if the external force is removed gradually from the operation shaft 12, the driving projection 14A is guided to the return guide groove 20D of the heart-shaped cam 20 and returns to the state shown in FIGS. 1 and 2. In the foregoing operation, the second drive member 16 and the operation shaft 12 do not have any pivotal movement as is conventional for the prior art, but need only move linearly in the E and F directions. Thus, the durability of the whole push-push switch is enhanced remarkably.

While the preferred embodiment has been described, variations thereto will occur to those skilled in the art within the scope of the present inventive concepts which are delineated by the following claims.

What is claimed is:

1. In a push-push switch of the type comprising an operation shaft reciprocatingly movable in an opening in a housing, switch contact means mounted to the operation shaft, a member mounted on the operation shaft having a projection extending transverse to the direction of reciprocation of the operation shaft, and a heart shaped cam mounted in the housing and adapted to be engaged by the projection of the member on the operation shaft for selectively locking the shaft at a certain position when the shaft is pushed inwardly in the housing, the improvement comprising:

said heart shaped cam mounted pivotally to said housing at a pivot end thereof toward said opening in said housing with a free end thereof remote from said opening, said cam having a cam path oriented substantially in a plane, and a substantially planar spring body having one hook piece at one end thereof for attachment to an inner surface of said housing and a second hook piece at another end thereof for attachment to said heart shaped cam adjacent said pivot end thereof such that said spring body is secured substantially parallel to the plane of said cam, and further having a spring portion extending at an angle from the plane of said spring body for exerting a biasing pressure to bias the free end of said heart shaped cam toward said operation shaft.

* * * * *